US009290824B2

(12) United States Patent
Watanabe et al.

(10) Patent No.: US 9,290,824 B2
(45) Date of Patent: Mar. 22, 2016

(54) METHOD OF PRODUCING GRAIN-ORIENTED ELECTRICAL STEEL SHEET

(75) Inventors: Makoto Watanabe, Tokyo (JP); Yukihiro Shingaki, Tokyo (JP); Toshito Takamiya, Tokyo (JP); Tomoyuki Okubo, Tokyo (JP); Kunihiro Senda, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 0 days.

(21) Appl. No.: 14/235,935

(22) PCT Filed: Aug. 15, 2012

(86) PCT No.: PCT/JP2012/070758

§ 371 (c)(1),
(2), (4) Date: Jan. 29, 2014

(87) PCT Pub. No.: WO2013/024874

PCT Pub. Date: Feb. 21, 2013

(65) Prior Publication Data

US 2015/0007908 A1 Jan. 8, 2015

(30) Foreign Application Priority Data

Aug. 18, 2011 (JP) ..... 2011-178841
Jul. 20, 2012 (JP) ..... 2012-161139

(51) Int. Cl.

| | |
|---|---|
| ***C21D 8/12*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***H01F 1/16*** | (2006.01) |
| ***H01F 1/147*** | (2006.01) |
| ***H01F 41/00*** | (2006.01) |
| ***C22C 38/16*** | (2006.01) |
| ***C22C 38/60*** | (2006.01) |
| ***C23C 22/33*** | (2006.01) |
| ***C23C 22/74*** | (2006.01) |

(52) U.S. Cl.

CPC ..... *C21D 8/1272* (2013.01); *C21D 8/12* (2013.01); *C21D 8/1244* (2013.01); *C21D 8/1283* (2013.01); *C22C 38/001* (2013.01); *C22C 38/004* (2013.01); *C22C 38/02* (2013.01); *C22C 38/04* (2013.01); *C22C 38/06* (2013.01); *C22C 38/16* (2013.01); *C22C 38/60* (2013.01); *C23C 22/33* (2013.01); *C23C 22/74* (2013.01); *H01F 1/14775* (2013.01); *H01F 1/16* (2013.01); *H01F 41/00* (2013.01); *C21D 2201/05* (2013.01)

(58) Field of Classification Search

CPC ..... H01F 41/04; H01F 1/16; C21D 6/00; C21D 8/12; C21D 8/1272; C21D 8/1283; C21D 8/1233; C21D 8/1266; C21D 9/46; C21D 2201/05; C22C 38/00; C22C 38/02; C22C 38/04; C22C 38/001; C22C 38/60

USPC ..... 148/111, 112, 307, 567, 601

See application file for complete search history.

(56) References Cited

U.S. PATENT DOCUMENTS

| | | | | |
|---|---|---|---|---|
| 4,504,957 | A | 3/1985 | McClelland | |
| 4,898,626 | A | 2/1990 | Shoen | |
| 5,833,768 | A | 11/1998 | Kosuge | |
| 6,287,392 | B1 | 9/2001 | Toda | |
| 6,613,160 | B2 | 9/2003 | Ushigami | |
| 6,811,619 | B2 * | 11/2004 | Hayakawa et al. | 148/111 |
| 7,857,915 | B2 | 12/2010 | Kumano | |
| 7,887,646 | B2 | 2/2011 | Nanba | |
| 7,942,982 | B2 * | 5/2011 | Kubo et al. | 148/113 |
| 2002/0000265 | A1 | 1/2002 | Toda | |
| 2010/0055481 | A1 | 3/2010 | Kubo | |
| 2011/0067786 | A1 | 3/2011 | Takashima | |
| 2011/0155285 | A1 * | 6/2011 | Kumano et al. | 148/208 |
| 2013/0074996 | A1 | 3/2013 | Omura | |
| 2014/0251514 | A1 * | 9/2014 | Watanabe et al. | 148/645 |
| 2014/0338794 | A1 * | 11/2014 | Shingaki et al. | 148/111 |

FOREIGN PATENT DOCUMENTS

| | | |
|---|---|---|
| CN | 101180411 A | 5/2008 |
| CN | 101528950 | 9/2009 |
| EP | 0716151 | 6/1996 |
| EP | 1057898 | 12/2000 |
| EP | 2746410 | 6/2014 |
| EP | 2757165 | 7/2014 |
| EP | 2770075 | 8/2014 |
| JP | 535800 | 1/1978 |

(Continued)

OTHER PUBLICATIONS

Chinese Office Action dated Aug. 4, 2014, application No. 201280035465.X, with English translation.

(Continued)

*Primary Examiner* — Matthew E Hoban
*Assistant Examiner* — John Hevey
(74) *Attorney, Agent, or Firm* — RatnerPrestia

(57) ABSTRACT

In a method of producing a grain-oriented electrical steel sheet by hot-rolling a steel slab of a chemical composition containing C: 0.001~0.10%, Si: 1.0~5.0%, Mn: 0.01~1.0%, at least one of S and Se: 0.01~0.05% in total, sol. Al: 0.003~0.050%, N: 0.001~0.020% by mass, subjecting to cold rolling, a primary recrystallization annealing, application of an annealing separator mainly composed of MgO and a finish annealing, a temperature rising rate S1 between 500~600° C. in the primary recrystallization annealing is made to not less than 100° C./s and a temperature rising rate S2 between 600~700° C. is made to 30° C./s~0.6×S1° C./s, while a total content W (mol %) of an element having an ionic radius of 0.6~1.3 Å and an attracting force between the ion and oxygen of not more than 0.7 $Å^{-2}$ included in the annealing separator to MgO is adjusted to satisfy 0.01S2−5.5≤Ln (W)≤0.01S2−4.3 to produce a grain-oriented electrical steel sheet having excellent iron loss properties and coating properties.

16 Claims, No Drawings

(56) References Cited

FOREIGN PATENT DOCUMENTS

| | | | |
|---|---|---|---|
| JP | 0578743 | | 3/1993 |
| JP | 6100996 | | 4/1994 |
| JP | 06179977 | | 6/1994 |
| JP | H07-062436 | A | 3/1995 |
| JP | H10-298653 | A | 11/1998 |
| JP | 2000063950 | | 2/2000 |
| JP | 2000144249 | | 5/2000 |
| JP | 2000204450 | | 7/2000 |
| JP | 2000256810 | | 9/2000 |
| JP | 2000355717 | | 12/2000 |
| JP | 2003-27194 | A | 1/2003 |
| JP | 2003-213339 | | 7/2003 |
| JP | 2003-253341 | A | 9/2003 |
| JP | 3537339 | | 3/2004 |
| JP | 2004-115858 | | 4/2004 |
| JP | 2004353054 | | 12/2004 |
| JP | 2008001977 | | 1/2008 |
| JP | 2010236013 | | 10/2010 |
| JP | 2011-6738 | A | 1/2011 |
| JP | 2011-174138 | A | 9/2011 |
| JP | 2012207278 | | 10/2012 |
| WO | 2011105054 | | 9/2011 |

OTHER PUBLICATIONS

International Preliminary Report on Patentability and Written Opinion dated Feb. 18, 2014, application No. PCT/JP2012/070758.
International Search Report mailed Oct. 30, 2012 for corresponding International Application No. PCT/JP2012/070758.
Chinese Office Action dated May 6, 2015 for Chinese Application No. 201280051569.X, including English translation.
Entire patent prosecution history of U.S. Appl. No. 14/344,805, filed Mar. 13, 2014, entitled, "Method of Producing Grain-Oriented Electrical Steel Sheet Having Excellent Iron Loss Properties."
Entire patent prosecution history of U.S. Appl. No. 14/352,904, filed Apr. 18, 2014, entitled, "Grain-Oriented Electrical Steel Sheet and Method of Producing the Same."
Entire patent prosecution history of U.S. Appl. No. 14/431,577, filed Mar. 26, 2015, entitled, "Method for Producing Grain-Oriented Electrical Steel Sheet."
European Search Report mailed Jun. 1, 2015 in European Application No. 12832398.7.
International Preliminary Report on Patentability and Written Opinion dated Mar. 18, 2014, application No. PCT/JP2012/073608.
International Preliminary Report on Patentability and Written Opinion dated Mar. 31, 2015 for International Application No. PCT/JP2012/074858.
International Search Report mailed Dec. 11, 2012 in International Application No. PCT/JP2012/073608.
International Search Report mailed Jan. 22, 2013 in International Application No. PCT/JP2012/076702.
Jan. 8, 2013 International Search Report issued in International Patent Application No. PCT/JP2012/074858.
Nov. 11, 2014 Office Action issued in Japanese Patent Application No. 2014-537945.
Sep. 1, 2015 extended European Search Report issued in European Patent Application No. 12885788.5.
Second Chinese Office Action dated Apr. 22, 2015 for Chinese Application No. 201280035465.X, with English translation.
Final Office Action mailed Oct. 23, 2015 for U.S. Appl. No. 14/235,652.
Non-Final Office Action mailed May 8, 2015 for U.S. Appl. No. 14/235,652.
European Search Report mailed Sep. 15, 2015 in European Application No. 12841595.7.
Final Office Action mailed Nov. 20, 2015 for U.S. Appl. No. 14/431,577.

* cited by examiner

METHOD OF PRODUCING GRAIN-ORIENTED ELECTRICAL STEEL SHEET

FIELD OF THE INVENTION

This invention relates to a method of producing a grain-oriented electrical steel sheet, and more particularly to a method of producing a grain-oriented electrical steel sheet having excellent iron loss properties and coating properties over a full length of a product coil. Here, the "coating" means a ceramic coating mainly composed of forsterite ($Mg_2SiO_4$) (hereinafter referred to as "coating" simply), and the "coating properties" mean appearance qualities of the coating such as presence or absence of color unevenness, point-like coating defect or the like.

BACKGROUND OF THE INVENTION

The electrical steel sheets are soft magnetic materials widely used as core materials for transformers, power generators or the like. Especially, grain-oriented electrical steel sheets have good iron loss properties directly leading to reduction of energy loss in transformers, power generators or the like because its crystal orientation is highly concentrated into {110}<001> orientation called Goss orientation. In order to improve the iron loss properties, it is known that reduction of sheet thickness, increase of specific electrical resistance by addition of Si or the like, improvement of orientation in the crystal orientation, application of tension to steel sheet, smoothing of steel sheet surface, refining of secondary recrystallized grains, magnetic domain refining and so on are effective.

Among them, a method of rapid heating during decarburization annealing or a method wherein a primary recrystallization texture is improved by rapid heating just before decarburization annealing is known as the technique for refining the secondary recrystallized grains. For example, Patent Document 1 discloses a technique of obtaining a grain-oriented electrical steel sheet with a low iron loss by rapid heating for a steel sheet rolled to a final thickness to 800~950° C. at a heating rate of not less than 100° C./s in an atmosphere having an oxygen concentration of not more than 500 ppm before decarburization annealing, and subjecting to decarburization annealing under conditions that a temperature of a preceding zone in the decarburization annealing is 775~840° C. lower than the temperature reached by the rapid heating and a temperature of subsequent zone is 815~875° C. higher than the temperature of the preceding zone, and Patent Document 2 discloses a technique of obtaining a grain-oriented electrical steel sheet with a low iron loss by heating a steel sheet rolled to a final thickness to a temperature of not lower than 700° C. at a heating rate of not less than 100° C./s in a non-oxidizing atmosphere having a $PH_2O/PH_2$ of not more than 0.2 just before decarburization annealing.

Also, Patent Document 3 discloses a technique of producing an electrical steel sheet having excellent coating properties and magnetic properties wherein a temperature zone of not lower than at least 600° C. in a temperature rising stage of a decarburization annealing step is heated above 800° C. at a temperature rising rate of not less than 95° C./s and an atmosphere of this temperature zone is constituted with an inert gas containing an oxygen of $10^{-6}$~$10^{-1}$ as a volume fraction, and an atmosphere in a soaking of the decarburization annealing is $H_2$ and $H_2O$ or $H_2$, $H_2O$ and an inert gas as a constituent and has $PH_2O/PH_2$ of 0.05~0.75 and a flow amount per unit area of 0.01~1 $Nm^3/min \cdot m^2$, and a deviation angle of a crystal orientation of crystal grains of the steel sheet in a mixed region between coating and steel sheet is controlled to an adequate range from Goss orientation, and Patent Document 4 discloses a technique of producing a grain-oriented electrical steel sheet having excellent coating properties and magnetic properties wherein a temperature zone of not lower than at least 650° C. in a temperature rising stage of a decarburization annealing step is heated above 800° C. at a temperature rising rate of not less than 100° C./s and an atmosphere of this temperature zone is an inert gas containing an oxygen of $10^{-6}$~$10^{-2}$ as a volume fraction, while an atmosphere in a soaking of the decarburization annealing is $H_2$ and $H_2O$ or $H_2$ and $H_2O$ and an inert gas as a constituent and has $PH_2O/PH_2$ of 0.15~0.65, whereby a discharge time indicating a peak of Al emission intensity in GDS analysis of a coating and a discharge time indicating that of Fe emission intensity is ½ of a bulk value are controlled to adequate ranges.

PATENT DOCUMENTS

Patent Document 1: JP-A-H10-298653
Patent Document 2: JP-A-H07-062436
Patent Document 3: JP-A-2003-27194
Patent Document 4: Japanese Patent No. 3537339

SUMMARY OF THE INVENTION

By applying these techniques secondary recrystallized grains are refined and the coating properties are improved, but there is a situation being hard to say perfect. For example, the technique of Patent Document 1 conducts the temperature keeping treatment at a temperature lower than the reaching temperature once the temperature is raised to a certain higher temperature, but the reaching temperature is frequently out of a target temperature because the control thereof is difficult. As a result, there is a problem that the variation of quality in the same coil or coil by coil is wide and is lacking in the stability. In the technique of Patent Document 2, $PH_2O/PH_2$ of the atmosphere in the temperature rising is decreased to not more than 0.2, but the improvement of the coating properties cannot be said to be sufficient because not only the partial pressure ratio $PH_2O/PH_2$ of $H_2O$ and $H_2$ but also the absolute partial pressure of $H_2O$ finally exert on the coating properties as disclosed in Patent Document 4, so that there remains room for further improvement.

In the technique of Patent Document 3, there is a feature that the orientation of the crystal grains in the mixed region between coating and base metal is shifted from Goss orientation, but this feature may bring about the deterioration of the magnetic properties when harmonic components are overlapped due to complicated magnetization procedure as being set into a transformer even though the magnetic properties in a cutlength sheet test piece are improved. In the technique of Patent Document 4, the temperature is raised at the same oxygen partial pressure as in Patent Document 3, so that there is a problem that the orientation of the crystal grains in the mixed region between coating and base metal is shifted from Goss orientation like Patent Document 3. Further, there is a problem that the peak position of Al in GDS is changed by delicate variation of chemical composition of the steel or production conditions at cold rolling step and becomes unstable. That is, the peak position of Al may be shifted toward the surface side of the steel sheet by delicate variation of ingredient such as Al, C, Si, Mn and the like, or by temperature profile, atmosphere or the like in the annealing of a hot rolled sheet, which causes a problem that the magnetic properties or coating properties become unstable.

The invention is made in view of the above problems of the conventional techniques and is to propose an advantageous production method of grain-oriented electrical steel sheets which provides low iron loss properties over a full length of a product coil by refining of secondary recrystallized grains and can form a uniform coating.

In order to solve the above problems, the inventors have focused on the temperature rising process in the primary recrystallization annealing and minor ingredients added to an annealing separator and have researched conditions required for refining secondary recrystallized grains stably and ensuring uniformity of a coating. As a result, it has been found out that it is effective to divide the heating process of the primary recrystallization annealing into a low temperature zone and a high temperature zone and to separately control the temperature rising rate in each temperature zone to an adequate range. That is, it has been known that the secondary recrystallized grains are refined by increasing the temperature rising rate in the primary recrystallization annealing, but the inventors have further examined and found that a temperature rising rate in a recovery process as a preliminary process of the primary recrystallization is made higher than a temperature rising rate in the usual decarburization annealing, while a temperature rising rate of a high temperature zone causing the primary recrystallization is restricted to not more than 60% of the temperature rising rate in the low temperature zone, whereby the bad influence by the variation of the production conditions can be avoided to stably provide the effect of reducing the iron loss. Furthermore, it has been found that a uniform coating can be stably formed by adjusting an amount of minor ingredient added to an annealing separator with an adequate range in response to the above temperature rising rate of the high temperature zone, and the invention has been accomplished.

The invention based on the above knowledge includes a method of producing a grain-oriented electrical steel sheet by hot-rolling a steel slab of a chemical composition comprising C: 0.001~0.10 mass %, Si: 1.0~5.0 mass %, Mn: 0.01~1.0 mass %, at least one of S and Se: 0.01~0.05 mass % in total, sol. Al: 0.003~0.050 mass %, N: 0.001~0.020 mass % and the balance being Fe and inevitable impurities, subjecting to single cold rolling or two or more cold rollings including an intermediate annealing therebetween to a final thickness and further to a primary recrystallization annealing, application of an annealing separator composed mainly of MgO and a finish annealing, characterized in that in the primary recrystallization annealing a temperature rising rate S1 between 500~600° C. is made to not less than 100° C./s and a temperature rising rate S2 between 600~700° C. is made to 30° C./s~0.6×S1° C./s, while a total content W (mol %) of an element having an ionic radius of 0.6~1.3 Å and an attracting force between ion and oxygen of not more than 0.7 $Å^{-2}$ included in the annealing separator to MgO is adjusted to satisfy the following equation (1) in relation to the S2:

$$0.01S2-5.5 \leq \mathrm{Ln}(W) \leq 0.01S2-4.3 \quad (1)$$

The production method of the grain-oriented electrical steel sheet according to an embodiment of the invention is characterized in that decarburization annealing is carried out after the primary recrystallization annealing.

Also, the production method of the grain-oriented electrical steel sheet according to an embodiment of the invention is characterized in that the element having an ionic radius of 0.6~1.3 Å and an attracting force between the ion and oxygen of not more than 0.7 $Å^{-2}$ is at least one of Ca, Sr, Li and Na.

Further, the production method of the grain-oriented electrical steel sheet according to an embodiment of the invention is characterized in that in addition to the above chemical composition, the steel slab contains at least one selected from Cu: 0.01~0.2 mass %, Ni: 0.01~0.5 mass %, Cr: 0.01~0.5 mass %, Sb: 0.01~0.1 mass %, Sn: 0.01~0.5 mass %, Mo: 0.01~0.5 mass % and Bi: 0.001~0.1 mass %.

Moreover, the production method of the grain-oriented electrical steel sheet according to an embodiment of the invention is characterized in that in addition to the above chemical composition, the steel slab contains at least one selected from B: 0.001~0.01 mass %, Ge: 0.001~0.1 mass %, As: 0.005~0.1 mass %, P: 0.005~0.1 mass %, Te: 0.005~0.1 mass %, Nb: 0.005~0.1 mass %, Ti: 0.005~0.1 mass % and V: 0.005~0.1 mass %.

According to the invention, the secondary recrystallized grains can be refined over a full length of a product coil of the grain-oriented electrical steel sheet to reduce iron loss, and further the uniform coating can be formed over the full length of the coil, so that the yield of the product can be largely improved. Further, iron loss properties of a transformer or the like can be highly improved by using a grain-oriented electrical steel sheet produced by the method of the invention.

DETAILED DESCRIPTION OF EMBODIMENTS OF THE INVENTION

First, the chemical composition of the steel slab as a raw material of the grain-oriented electrical steel sheet of embodiments of the invention will be described.

C: 0.001~0.10 mass %

C is an element useful for generating grains of Goss orientation and is necessary to be included in an amount of not less than 0.001 mass % in order to develop such an effect. While, when C exceeds 0.10 mass %, it is difficult to decarburize to not more than 0.005 mass % in subsequent decarburization annealing for not causing magnetic aging. Therefore, C is in the range of 0.001~0.10 mass %. Preferably, it is in the range of 0.01~0.08 mass %.

Si: 1.0~5.0 mass %

Si is an element required for increasing an electric resistance of steel to reduce iron loss and stabilizing BCC structure of iron to conduct a heat treatment at a higher temperature, and is necessary to be added in an amount of at least 1.0 mass %. However, the addition exceeding 5.0 mass % hardens steel and is difficult to conduct cold rolling. Therefore, Si is in the range of 1.0~5.0 mass %. Preferably, it is in the range of 2.5~4.0 mass %.

Mn: 0.01~1.0 mass %

Mn effectively contributes to improve the hot brittleness of steel and is also an element forming precipitates of MnS, MnSe or the like to develop a function as an inhibitor when S and Se are included. When Mn content is less than 0.01 mass %, the above effects are not obtained sufficiently, while when it exceeds 1.0 mass %, the precipitates such as MnSe and the like are coarsened to lose the effect as an inhibitor. Therefore, Mn is in the range of 0.01~1.0 mass %. Preferably, it is in the range of 0.04~0.40 mass %.

sol. Al: 0.003~0.050 mass %

Al is a useful element forming AlN in steel, which precipitates as a second dispersion phase and acts as an inhibitor. However, when the addition amount is less than 0.003 mass % as sol. Al, the amount of AlN precipitated is insufficient, while when it exceeds 0.050 mass %, AlN is coarsely precipitated to lose the action as an inhibitor. Therefore, Al is in the range of 0.003~0.050 mass % as sol. Al. Preferably, it is in the range of 0.01~0.04 mass %.

N: 0.001~0.020 mass %

N is an element required for forming AlN, like Al. However, when the addition amount is less than 0.001 mass %, the precipitation of AlN is insufficient, while when it exceeds 0.020 mass %, blistering or the like is caused in the heating of the slab. Therefore, N is in the range of 0.001~0.020 mass %. Preferably, it is in the range of 0.005~0.010 mass %.

At least one of S and Se: 0.01~0.05 mass % in total

S and Se are useful elements developing the action as an inhibitor which form MnSe, MnS, $Cu_{2-x}Se$ or $Cu_{2-x}S$ by bonding with Mn or Cu and precipitating into steel as a second dispersion phase. When the total amount of S and Se is less than 0.01 mass %, the above effect is not obtained sufficiently, while when it exceeds 0.05 mass %, not only solution is insufficient in the heating of the slab, but also it causes surface defects in a product sheet. Therefore, S and Se are in the range of 0.01~0.05 mass % in any of the single addition and the composite addition. Preferably, they are in the range of 0.01~0.03 mass % in total.

In addition to the above necessary ingredients, the steel slab in the grain-oriented electrical steel sheet of the invention may contain at least one selected from Cu: 0.01~0.2 mass %, Ni: 0.01~0.5 mass %, Cr: 0.01~0.5 mass %, Sb: 0.01~0.1 mass %, Sn: 0.01~0.5 mass %, Mo: 0.01~0.5 mass % and Bi: 0.001~0.1 mass %.

Cu, Ni, Cr, Sb, Sn, Mo and Bi are elements easily segregating into crystal grain boundary or surface and also are elements having a subsidiary action as an inhibitor, so that they can be added for the purpose of further improving the magnetic properties. However, when the addition amount of any element is less than the above lower limit, the effect of suppressing the coarsening of the primary recrystallized grains at a higher temperature zone of the secondary recrystallization process is insufficient, while when the addition amount exceeds the above upper limit, there is a fear of causing poor appearance of the coating or poor secondary recrystallization. Therefore, if they are added, it is preferable to add them at the aforementioned range.

In addition to the above necessary ingredients and arbitrary addition ingredients, the steel slab in the grain-oriented electrical steel sheet of the invention may contain at least one selected from B: 0.001~0.01 mass %, Ge: 0.001~0.1 mass %, As: 0.005~0.1 mass %, P: 0.005~0.1 mass %, Te: 0.005~0.1 mass %, Nb: 0.005~0.1 mass %, Ti: 0.005~0.1 mass % and V: 0.005~0.1 mass %.

B, Ge, As, P, Te, Nb, Ti and V have also a subsidiary action as an inhibitor and are elements effective for further improving the magnetic properties. However, when they are less than the above addition amount, the effect of suppressing the coarsening of the primary recrystallized grains at a higher temperature zone of the secondary recrystallization process is insufficient, while when the addition amount exceeds the above upper limit, there is a fear of causing poor secondary recrystallization or poor appearance of the coating. Therefore, if they are added, it is preferable to add them at the aforementioned range.

Next, the production method of the grain-oriented electrical steel sheet according to embodiments of the invention will be described.

The grain-oriented electrical steel sheet of the invention is preferably produced by a method comprising a series of steps of melting steel having the aforementioned chemical composition by a conventionally well-known refining process, forming a raw steel material (steel slab) by a method such as continuous casting method, ingot forming-blooming method or the like, hot rolling the steel slab to form a hot rolled sheet, subjecting the hot rolled sheet to an annealing if necessary, subjecting to a single cold rolling or two or more cold rollings including intermediate annealing to form a cold rolled sheet of a final thickness, subjecting the cold rolled sheet to a primary recrystallization annealing and a decarburization annealing, applying an annealing separator composed mainly of MgO, subjecting to a final finish annealing and thereafter subjecting to a flattening annealing combined with application/baking of an insulation coating, if necessary.

In this production method, the producing conditions other than the primary recrystallization annealing and the annealing separator are not particularly limited because the conventionally well-known methods can be adopted. Therefore, the primary recrystallization annealing conditions and the conditions on the annealing separator will be described below.

<Primary Recrystallization Annealing>

The condition of subjecting the cold rolled sheet of the final thickness to the primary recrystallization annealing, particularly temperature rising rate in the heating process has a large influence on the secondary recrystallization structure as previously mentioned, so that it is required to severely control the temperature rising rate. In the invention, therefore, the heating process is preferably divided into a low temperature zone proceeding the recovery and a high temperature zone causing the primary recrystallization and the temperature rising rate in each zone is controlled properly in order that secondary recrystallized grains are stably refined over a full length of the product coil to enhance a ratio of a portion being excellent in the iron loss properties of the product coil.

Concretely, the temperature rising rate S1 of the low temperature zone (500~600° C.) causing the recovery as a precursor process of the primary recrystallization is made to not less than 100° C./s higher than the usual case, while the temperature rising rate S2 of the high temperature zone (600~700° C.) causing the primary recrystallization is made to not less than 30° C./s and not more than 60% of the temperature rising rate of the low temperature zone. Thus, even if the chemical composition of the steel or the producing conditions before the primary recrystallization annealing are varied, the secondary recrystallized grains can be refined to provide low iron loss over the full length of the product coil.

Explaining this reason, it is known that the secondary recrystallization nucleus of Goss orientation {110}<001> is existent in a deformation band caused in <111> fiber texture liable to store strain energy in a rolled texture. The deformation band is a region particularly storing strain energy in the <111> fiber texture.

When the temperature rising rate S1 in the low temperature zone (500~600° C.) as the heating process of the primary recrystallization annealing is less than 100° C./s, the recovery (lessening of strain energy) is preferentially caused in the deformation band having a very high strain energy, so that the recrystallization of Goss orientation {110}<001> cannot be promoted. On the contrary, when S1 is made to not less than 100° C./s, the deformation structure can be kept up to a higher temperature at a high strain energy state, so that the recrystallization of Goss orientation {110}<001> can be caused at a relatively low temperature (about 600° C.). This is the reason for making S1 to not less than 100° C./s. Preferably, S1 is not less than 120° C./s.

On the other hand, in order to control the size of the secondary recrystallized grains of Goss orientation {110}<001>, it is important to control an amount of <111> structure encroached by the Goss orientation {110}<001> to a proper range. That is, when <111> orientation is too large, the growth of the secondary recrystallized grains is promoted and there is a fear that even if there are many nuclei of Goss orientation {110}<001>, one structure is coarsened to form coarse grains before the growth of these nuclei, while when <111> orientation is too small, it is difficult to grow the secondary recrystallized grains and there is a fear of causing failure of secondary recrystallization.

Since the <111> orientation is caused by recrystallization from <111> fiber texture having strain energy higher than that of the surroundings though it does not have as much strain energy as the deformation band, it is a crystal orientation easily causing recrystallization next to Goss orientation {110}<001> in the heat cycle of the invention wherein the heating is carried out at the temperature rising rate S1 up to 600° C. of not less than 100° C./s. Therefore, when the heating is carried out at a high temperature rising rate up to such a high temperature that crystal grains other than Goss orientation cause the primary recrystallization (not lower than 700° C.), Goss orientation {110}<001> and subsequently recrystallizable <111> orientation reach to the high temperature at a recrystallization suppressed state and thereafter all orientations cause recrystallization at once. As a result, the texture after the primary recrystallization is randomized to decrease Goss orientation {110}<001> and the secondary recrystallized grains cannot grow sufficiently. In the invention, therefore, the temperature rising rate S2 at 600~700° C. is preferably made to not more than 0.6×S1° C./s, lower than the temperature rising rate defined by S1.

Inversely, when the temperature rising rate at 600~700° C. is less than 30° C./s, the recrystallizable <111> orientation subsequent to Goss orientation {110}<001> increases, and hence there is a fear of coarsening the secondary recrystallized grains. The above is the reason why S2 is made to not less than 30° C./s but not more than 0.6×S1° C./s. Preferably, the lower limit of S2 is 50° C./s, and the upper limit thereof is 0.55×S1° C./s.

Thus, the lowering of the temperature rising rate S2 at the high temperature zone has a beneficial influence on not only the crystal orientation but also the coating formation. Because, although the formation of the coating starts from about 600° C. in the heating process, if rapid heating is conducted at this temperature zone, soaking treatment is attained at a state that initial oxidation is lacking, so that violent oxidation occurs during the soaking and hence subscale silica ($SiO_2$) takes a dendrite-like form extended in the form of a rod toward the interior of the steel sheet. If finish annealing is carried out in such a state, $SiO_2$ hardly moves to the surface and free forsterite generates in the interior of the iron matrix, which result in the deterioration of the magnetic properties or coating properties. Thus, the above harmful effects of the rapid heating can be avoided by lowering S2.

In Patent Documents 1~4 is disclosed a technique of improving an atmosphere conditions during the heating. In these documents, however, rapid heating is carried out at a high temperature zone of 600~700° C., so that there is a variation in the achieving temperature at the end of the rapid heating and it is difficult to control the form of the subscale. Therefore, the uniformity of the subscale in a product coil cannot be ensured and it is difficult to obtain a product sheet being excellent in the magnetic properties and coating properties over a full length thereof.

Moreover, the primary recrystallization annealing may be conducted according to the usual manner and the other conditions in the primary recrystallization annealing after the final cold rolling such as soaking temperature, soaking time, atmosphere in the soaking, cooling rate and the like are not particularly limited.

In general, the primary recrystallization annealing is frequently carried out in combination with decarburization annealing. Even in the invention, the primary recrystallization annealing combined with the decarburization annealing may be conducted, but the decarburization annealing may be separately carried out after the primary recrystallization annealing.

In addition, nitriding is commonly carried out before or after the primary recrystallization annealing or during the primary recrystallization annealing to reinforce an inhibitor. Even in the invention, it is possible to apply the nitriding.

<Annealing Separator>

The steel sheet after the primary recrystallization annealing or further after the decarburization annealing is subjected to application of an annealing separator and finish annealing to conduct secondary recrystallization. As the feature of embodiments of the invention, the content of minor ingredients added to the annealing separator is adjusted to a proper range in response to the temperature rising rate S2, while the minor ingredient is limited to an element having an ion radius of 0.6~1.3 Å and an attracting force between the ion and oxygen of not more than 0.7 $Å^{-2}$. Elements satisfying these conditions are Ca, Sr, Li and Na. They may be added alone or in a combination of two or more.

The reason why the ion radius of the minor ingredients added is limited to a range of 0.6~1.3 Å is due to the fact that it is near to an ion radius of 0.78 Å for the magnesium ion of MgO which is a main ingredient of the annealing separator. That is, the reaction of forming the coating is a forsterite forming reaction by moving $Mg^{2+}$ ion or $O^{2-}$ ion in the annealing separator through diffusion to react with $SiO_2$ on the surface of the steel sheet as follows:

$$2MgO+SiO_2 \rightarrow Mg_2SiO_4$$

By introducing the element having an ion radius of the above range, the above reaction can be promoted because $Mg^{2+}$ ion is replaced by the above ions during the finish annealing, while lattice defect is introduced into MgO lattices by mismatch of the lattice resulted from the difference of the ion radius to easily cause diffusion. When the ion radius is too large or too small over the above range, the replacement reaction with $Mg^{2+}$ ion is not caused and hence the reaction promoting effect cannot be expected.

The ion radius acts to the side of MgO as mentioned above, whereas the attracting force between the ion and oxygen is a value represented by $2Z/(R_I+R_O)^2$ when an ion radius of an atom is $R_I$ and its valence is Z and an ion radius of oxygen ion is $R_O$ and its valence is 2, which is an indication showing a degree of acting mainly on $SiO_2$ of the subscale side with the addition of the minor ingredient. Concretely, as the value becomes smaller, enrichment of $SiO_2$ into the surface layer is promoted during the finish annealing.

That is, it is considered that $SiO_2$ moves toward the surface layer of the steel sheet through dissociation-reaggregation process such as Ostwald growth in the formation of the coating. In this case, when an ion having an attracting force between the ion and oxygen of not more than 0.7 $Å^{-2}$ is introduced, the bond of $SiO_2$ is cut to easily cause the dissociation process and $SiO_2$ is enriched onto the surface layer to enhance a chance of contacting with MgO and promote the forsterite forming reaction. However, when the attracting force between the ion and oxygen exceeds 0.7 $Å^{-2}$, the above effect is not obtained.

Also, it is necessary that the content of the ingredient in the annealing separator satisfying the above conditions is controlled to a range satisfying the following equation (1):

$$0.01\times S2-5.5 \leq Ln(W) \leq 0.01\times S2-4.3 \quad (1)$$

in response to the temperature rising rate S2 at the high temperature zone of the primary recrystallization annealing when an addition amount to MgO is W (mol %).

When the temperature rising rate S2 at the high temperature zone is too high, the resulting dendrite-like silica ($SiO_2$) in subscale deeply penetrates beneath the surface layer of the steel sheet, so that it is necessary to promote the movement of $SiO_2$ to the surface of the steel sheet during the finish annealing by increasing the addition amount of the minor ingredient. Conversely, when S2 is too low, the dendrite-like silica does not penetrate deeply, so that $SiO_2$ can move to the surface of the steel sheet even if the addition amount of the minor ingredient is small. Therefore, the addition amount W of the minor ingredient is necessary to be adjusted to a proper range in response to the temperature rising rate S2. When W is lower than the range of the equation (1), the effect of promoting the movement of $SiO_2$ to the surface is not obtained, while when it exceeds the range of the equation (1), the movement of $SiO_2$ to the surface considerably progresses and the form of forsterite is deteriorated to cause poor appearance of the coating. Preferably, the lower limit of Ln (W) is 0.01×S2−5.2, and the upper limit thereof is 0.01×S2−4.5.

As the minor ingredient added to the annealing separator may be added conventionally well-known titanium oxide, borate, chloride or the like in addition to the aforementioned elements. They have an effect of improving the magnetic properties and an effect of increasing the amount of the coating by additional oxidation, and also these effects are independent of the above minor ingredient, so that they may be added compositely.

Moreover, the annealing separator is preferably to be applied in an amount of 8~14 g/$m^2$ on both surfaces as a slurry-like coating liquid so as to have a hydrated ignition loss of 0.5~3.7 mass % and then dried.

In the production method of the grain-oriented electrical steel sheet according to the invention, magnetic domain refining treatment of irradiating laser, plasma, electron beams or the like may be carried out after the finish annealing and formation of insulation coating. Particularly, the means for reinforcing the coating according to the invention can be utilized effectively in the method of irradiating electron beams. That is, the irradiation of electron beams is liable to easily exfoliate the coating because electron beams transmit the coating to raise the surface temperature of the steel sheet. On the contrary, according to the invention, the homogeneous and strong coating can be formed by promoting the reaction of forming forsterite, whereby the exfoliating of the coating with the irradiation of electron beams can be suppressed.

Example 1

A steel slab containing C: 0.06 mass %, Si: 3.3 mass %, Mn: 0.08 mass %, S: 0.023 mass %, sol. Al: 0.03 mass %, N: 0.007 mass %, Cu: 0.2 mass % and Sb: 0.02 mass % is heated to 1430° C. and soaked for 30 minutes and then hot-rolled to form a hot rolled sheet having a thickness of 2.2 mm, which is subjected to an annealing at 1000° C. for 1 minute and then cold-rolled to form a cold rolled sheet having a thickness of 0.23 mm. Thereafter, the sheet is heated by changing a temperature rising rate S1 between 500° C. and 600° C. and a temperature rising rate S2 between 600° C. and 700° C., respectively, as shown in Table 1 and then subjected to primary recrystallization annealing combined with decarburization annealing by soaking at 840° C. for 2 minutes. Next, a slurry of an annealing separator composed mainly of MgO and containing 10 mass % of $TiO_2$ and a variable amount of a minor ingredient(s) having different ion radii and ion-oxygen attracting forces as shown in Table 1 in the form of an oxide is applied to the sheet in an amount of 12 g/$m^2$ (per both surfaces) so as to render a hydrated ignition loss into 3.0 mass %, and then the sheet is dried, reeled in a coil, subjected to finish annealing, followed by the application of a coating liquid of magnesium phosphate-colloidal silica-chromic anhydride-silica powder and then subjected to flattening annealing combined with baking of the coating liquid and straightening of steel sheet shape at 800° C. for 30 seconds to obtain a product coil.

From the product coil thus obtained are repeatedly collected test specimens at a given interval in the longitudinal direction to measure iron loss over the full length of the coil, from which is determined a ratio of a portion having an iron loss $W_{17/50}$ of not more than 0.80 W/kg over the full length of the product coil. Also, the surface of the steel sheet is visually inspected during the collection of the test specimen to confirm the presence or absence of coating fault such as color shading, point-like coating defect or the like, from which is determined a ratio of non-defective parts having no coating fault over the full length.

The results are also shown in Table 1. As seen from these results, the steel sheets of Invention Examples produced under conditions of the temperature rising rate and addition of the minor ingredient in the annealing separator adaptable to the invention are good in the magnetic properties and coating properties because the ratio of $W_{17/50}$≤0.80 W/kg is not less than 70% and the ratio of parts having a good coating appearance is not less than 99% over the full length.

TABLE 1

| | Temperature rising rate of primary recrystallization annealing | | | Minor ingredient(s) in annealing separator | | | | | Ratio of good parts in product (%) | | |
|---|---|---|---|---|---|---|---|---|---|---|---|
| No. | S1 (° C./s) | S2 (° C./s) | S2/S1 | Kind of element | Ion radius (Å) | Ion-oxygen attracting force ($Å^{-2}$) | Content W (mol %) | Ln (W) | Iron loss property | Coating property | Remarks |
| 1 | 20 | 5 | 0.25 | Ca | 1.14 | 0.62 | 0.005 | −5.3 | 0 | 99 | Comparative Example |
| 2 | | 10 | 0.50 | Ca | 1.14 | 0.62 | 0.008 | −4.8 | 0 | 99 | Comparative Example |
| 3 | | 15 | 0.75 | Ca | 1.14 | 0.62 | 0.011 | −4.5 | 0 | 100 | Comparative Example |
| 4 | | 20 | 1.00 | Ca | 1.14 | 0.62 | 0.015 | −4.2 | 0 | 100 | Comparative Example |
| 5 | 80 | 15 | 0.19 | Ca | 1.14 | 0.62 | 0.005 | −5.3 | 0 | 99 | Comparative Example |
| 6 | | 30 | 0.38 | Ca | 1.14 | 0.62 | 0.008 | −4.8 | 0 | 100 | Comparative Example |
| 7 | | 60 | 0.75 | Ca | 1.14 | 0.62 | 0.011 | −4.5 | 0 | 100 | Comparative Example |
| 8 | | 80 | 1.00 | Ca | 1.14 | 0.62 | 0.015 | −4.2 | 0 | 100 | Comparative Example |
| 9 | 100 | 20 | 0.20 | Ca | 1.14 | 0.62 | 0.005 | −5.3 | 30 | 100 | Comparative Example |
| 10 | | 30 | 0.30 | Ca | 1.14 | 0.62 | 0.010 | −4.6 | 70 | 100 | Invention Example |
| 11 | | 40 | 0.40 | Ca | 1.14 | 0.62 | 0.015 | −4.2 | 85 | 100 | Invention Example |
| 12 | | 50 | 0.50 | Ca | 1.14 | 0.62 | 0.017 | −4.1 | 90 | 100 | Invention Example |

TABLE 1-continued

| No. | Temperature rising rate of primary recrystallization annealing S1 (° C./s) | S2 (° C./s) | S2/S1 | Minor ingredient(s) in annealing separator: Kind of element | Ion radius (Å) | Ion-oxygen attracting force ($Å^{-2}$) | Content W (mol %) | Ln (W) | Ratio of good parts in product (%): Iron loss property | Coating property | Remarks |
|---|---|---|---|---|---|---|---|---|---|---|---|
| 13 | | 60 | 0.60 | Ca | 1.14 | 0.62 | 0.019 | −4.0 | 75 | 100 | Invention Example |
| 14 | | 70 | 0.70 | Ca | 1.14 | 0.62 | 0.020 | −3.9 | 60 | 99 | Comparative Example |
| 15 | | 100 | 1.00 | Ca | 1.14 | 0.62 | 0.021 | −3.9 | 35 | 98 | Comparative Example |
| 16 | 200 | 20 | 0.10 | Ca | 1.14 | 0.62 | 0.005 | −5.3 | 45 | 99 | Comparative Example |
| 17 | | 30 | 0.15 | Ca | 1.14 | 0.62 | 0.010 | −4.6 | 90 | 100 | Invention Example |
| 18 | | 50 | 0.25 | Ca | 1.14 | 0.62 | 0.015 | −4.2 | 100 | 100 | Invention Example |
| 19 | | 100 | 0.50 | Ca | 1.14 | 0.62 | 0.020 | −3.9 | 95 | 100 | Invention Example |
| 20 | | 120 | 0.60 | Ca | 1.14 | 0.62 | 0.025 | −3.7 | 80 | 100 | Invention Example |
| 21 | | 140 | 0.70 | Ca | 1.14 | 0.62 | 0.028 | −3.6 | 55 | 98 | Comparative Example |
| 22 | | 200 | 1.00 | Ca | 1.14 | 0.62 | 0.030 | −3.5 | 50 | 95 | Comparative Example |
| 23 | 400 | 20 | 0.05 | Ca | 1.14 | 0.62 | 0.005 | −5.3 | 40 | 100 | Comparative Example |
| 24 | | 30 | 0.08 | Ca | 1.14 | 0.62 | 0.010 | −4.6 | 85 | 100 | Invention Example |
| 25 | | 50 | 0.13 | Ca | 1.14 | 0.62 | 0.015 | −4.2 | 95 | 100 | Invention Example |
| 26 | | 200 | 0.50 | Ca | 1.14 | 0.62 | 0.050 | −3.0 | 100 | 100 | Invention Example |
| 27 | | 250 | 0.63 | Ca | 1.14 | 0.62 | 0.100 | −2.3 | 55 | 95 | Comparative Example |
| 28 | | 400 | 1.00 | Ca | 1.14 | 0.62 | 0.250 | −1.4 | 50 | 93 | Comparative Example |
| 29 | 100 | 40 | 0.40 | Sr | 1.30 | 0.55 | 0.010 | −4.6 | 95 | 100 | Invention Example |
| 30 | | 40 | 0.40 | Ba | 1.50 | 0.48 | 0.010 | −4.6 | 80 | 45 | Comparative Example |
| 31 | | 40 | 0.40 | Li | 0.88 | 0.38 | 0.010 | −4.6 | 100 | 100 | Invention Example |
| 32 | | 40 | 0.40 | Na | 1.16 | 0.30 | 0.010 | −4.6 | 90 | 100 | Invention Example |
| 33 | | 40 | 0.40 | K | 1.52 | 0.23 | 0.010 | −4.6 | 80 | 30 | Comparative Example |
| 34 | | 40 | 0.40 | Sn | 0.83 | 1.61 | 0.010 | −4.6 | 85 | 70 | Comparative Example |
| 35 | 100 | 20 | 0.20 | Ca + Sr | — | — | 0.005 | −5.3 | 50 | 100 | Comparative Example |
| 36 | | 30 | 0.30 | Ca + Sr | — | — | 0.010 | −4.6 | 75 | 100 | Invention Example |
| 37 | | 40 | 0.40 | Ca + Li | — | — | 0.015 | −4.2 | 95 | 100 | Invention Example |
| 38 | | 50 | 0.50 | Ca + Na | — | — | 0.017 | −4.1 | 80 | 100 | Invention Example |
| 39 | | 60 | 0.60 | Ca + Sr | — | — | 0.019 | −4.0 | 75 | 100 | Invention Example |
| 40 | | 70 | 0.70 | Sr + Li | — | — | 0.020 | −3.9 | 65 | 99 | Comparative Example |
| 41 | | 100 | 1.00 | Ca + Li | — | — | 0.021 | −3.9 | 30 | 95 | Comparative Example |
| 42 | 100 | 30 | 0.30 | Ca + Li | — | — | 0.003 | −5.8 | 60 | 60 | Comparative Example |
| 43 | | 40 | 0.40 | Ca + Li | — | — | 0.010 | −4.6 | 90 | 100 | Invention Example |
| 44 | | 50 | 0.50 | Ca + Li | — | — | 0.025 | −3.7 | 75 | 65 | Comparative Example |

Example 2

A steel slab having a chemical composition shown in Table 2 is heated to 1430° C. and soaked for 30 minutes and hot-rolled to form a hot rolled sheet having a thickness of 2.2 mm, which is subjected to an annealing at 1000° C. for 1 minute, cold-rolled to a thickness of 1.5 mm, subjected to middle annealing at 1100° C. for 2 minutes and further cold-rolled to form a cold rolled sheet having a final thickness of 0.23 mm. The cold rolled sheet is subjected to magnetic domain refining treatment for the formation of linear groove by electrolytic etching and heated to 700° C. under such a condition that a temperature rising rate S1 between 500° C. and 600° C. is 200° C./s and a temperature rising rate S2 between 600° C. and 700° C. is 50° C./s, and then subjected to primary recrystallization annealing combined with decarburization annealing at 840° C. in an atmosphere having $PH_2O/PH_2$ of 0.4 for 2 minutes. Next, a slurry of an annealing separator composed mainly of MgO and containing 10 mass % of $TiO_2$ and a variable amount of an oxide of Li having an ion radius of 0.88 Å and an ion-oxygen attracting force of 0.38 $Å^{-2}$ is applied to the sheet in an amount of 12 g/m$^2$ (per both surfaces) so as to render a hydrated ignition loss into 3.0 mass %, and then the sheet is dried, reeled in a coil, subjected to finish annealing, followed by the application of a coating liquid of magnesium phosphate-colloidal silica-chromic anhydride-silica powder and then subjected to flattening annealing combined with baking of the coating liquid and straightening of steel strip shape at 800° C. for 20 seconds to obtain a product coil.

From the product coil thus obtained are repeatedly collected test specimens at a given interval in the longitudinal direction, which are subjected to stress relief annealing at 800° C. in a nitrogen atmosphere for 3 hours and thereafter an iron loss $W_{17/50}$ is measured by an Epstein test to determine a ratio of a portion having an iron loss $W_{17/50}$ of not more than 0.80 W/kg over the full length of the product coil. Also, the surface of the steel sheet is visually inspected during the collection of the test specimen to confirm the presence or absence of coating fault such as color shading, point-like coating defect or the like, from which is determined a ratio of non-defective parts having no coating fault over the full length.

The results are also shown in Table 2. As seen from these results, the steel sheets of Invention Examples produced under conditions of the temperature rising rate and addition of the minor ingredient in the annealing separator adaptable to the invention are good in the magnetic properties and coating properties because the ratio of $W_{17/50} \leq 0.80$ W/kg is not less than 70% and the ratio of parts having a good coating appearance is not less than 99% over the full length.

TABLE 2

| | Chemical composition of steel sheet (mass %) | | | | | | | | | Annealing separator | | Steel sheet properties | | |
|---|---|---|---|---|---|---|---|---|---|---|---|---|---|---|
| | | | | | | | | | | Li content | | Good ratio on iron loss | Good ratio on coating | |
| No. | C | Si | Mn | S | Se | S + Se | Sol. Al | N | Others | (mol %) | Ln (W) | (%) | (%) | Remarks |
| 1 | 0.1 | 3.1 | 0.1 | — | 0.02 | 0.02 | 0.03 | 0.01 | — | 0.01 | −4.6 | 90 | >99 | Invention Example |
| 2 | 0.1 | 3.1 | 0.1 | 0.02 | — | 0.02 | 0.03 | 0.01 | — | 0.01 | −4.6 | 85 | >99 | Invention Example |
| 3 | 0.1 | 3.1 | 0.1 | — | 0.02 | 0.02 | 0.03 | 0.01 | Cu: 0.2 | 0.01 | −4.6 | 95 | >99 | Invention Example |
| 4 | 0.1 | 3.1 | 0.1 | — | 0.02 | 0.02 | 0.03 | 0.01 | Cr: 0.01 | 0.01 | −4.6 | 95 | >99 | Invention Example |
| 5 | 0.1 | 3.1 | 0.1 | — | 0.02 | 0.02 | 0.03 | 0.01 | Ni: 0.01 | 0.01 | −4.6 | 100 | >99 | Invention Example |
| 6 | 0.1 | 3.1 | 0.1 | — | 0.02 | 0.02 | 0.03 | 0.01 | Ni: 0.8, Sb: 0.005 | 0.01 | −4.6 | 100 | >99 | Invention Example |
| 7 | 0.1 | 3.1 | 0.1 | — | 0.02 | 0.02 | 0.03 | 0.01 | Sb: 0.1 | 0.01 | −4.6 | 100 | >99 | Invention Example |
| 8 | 0.1 | 3.1 | 0.1 | — | 0.02 | 0.02 | 0.03 | 0.01 | Sb: 0.005, Sn: 0.005 | 0.01 | −4.6 | 95 | >99 | Invention Example |
| 9 | 0.1 | 3.1 | 0.1 | — | 0.02 | 0.02 | 0.03 | 0.01 | Mo: 0.5 | 0.01 | −4.6 | 95 | >99 | Invention Example |
| 10 | 0.1 | 3.1 | 0.1 | — | 0.02 | 0.02 | 0.03 | 0.01 | Bi: 0.001 | 0.01 | −4.6 | 100 | >99 | Invention Example |
| 11 | 0.1 | 3.1 | 0.1 | — | 0.02 | 0.02 | 0.03 | 0.01 | B: 0.001 | 0.01 | −4.6 | 100 | >99 | Invention Example |
| 12 | 0.1 | 3.1 | 0.1 | — | 0.02 | 0.02 | 0.03 | 0.01 | P: 0.06 | 0.01 | −4.6 | 100 | >99 | Invention Example |
| 13 | 0.1 | 3.1 | 0.1 | — | 0.02 | 0.02 | 0.03 | 0.01 | Nb: 0.01 | 0.01 | −4.6 | 95 | >99 | Invention Example |
| 14 | 0.1 | 3.1 | 0.1 | — | 0.02 | 0.02 | 0.03 | 0.01 | V: 0.02 | 0.01 | −4.6 | 95 | >99 | Invention Example |
| 15 | 0.1 | 3.1 | 0.1 | — | 0.02 | 0.02 | 0.03 | 0.01 | — | 0.005 | −5.3 | 70 | 62 | Comparative Example |
| 16 | 0.1 | 3.1 | 0.1 | — | 0.02 | 0.02 | 0.03 | 0.01 | Sb: 0.005, Sn: 0.005 | 0.005 | −5.3 | 75 | 68 | Comparative Example |
| 17 | 0.1 | 3.1 | 0.1 | — | 0.02 | 0.02 | 0.03 | 0.01 | — | 0.03 | −3.5 | 80 | 58 | Comparative Example |
| 18 | 0.1 | 3.1 | 0.1 | — | 0.02 | 0.02 | 0.03 | 0.01 | Sb: 0.005, Sn: 0.005 | 0.03 | −3.5 | 80 | 61 | Comparative Example |

Example 3

A steel slab containing C: 0.06 mass %, Si: 3.3 mass %, Mn: 0.08 mass %, S: 0.023 mass %, sol. Al: 0.03 mass %, N: 0.007 mass %, Cu: 0.2 mass % and Sb: 0.02 mass % is heated to 1430° C. and soaked for 30 minutes and hot-rolled to form a hot rolled sheet having a thickness of 2.2 mm, which is subjected to annealing at 1000° C. for 1 minute and cold-rolled to form a cold rolled sheet having a thickness of 0.23 mm. Thereafter, the sheet is subjected to primary recrystallization annealing by heating to 700° C. under such a condition that a temperature rising rate S1 between 500° C. and 600° C. is 200° C./s and a temperature rising rate S2 between 600° C. and 700° C. is 50° C./s and then cooling as primary recrystallization annealing and further to decarburization annealing at 840° C. in an atmosphere of $PH_2O/PH_2$=0.4 for 2 minutes. Next, a slurry of an annealing separator composed mainly of MgO and containing 10 mass % of $TiO_2$, 5 mass % of magnesium sulfate and a variable amount of an oxide of Sr having an ion radius of 1.3 Å and an ion-oxygen attracting force of 0.55 $Å^{-2}$ is applied to the sheet in an amount of 12 $g/m^2$ (per both surfaces) so as to render a hydrated ignition loss into 3.0 mass %, and then the sheet is dried, reeled in a coil, subjected to finish annealing, followed by the application of a coating liquid of magnesium phosphate-colloidal silica-chromic anhydride-silica powder, subjected to flattening annealing combined with baking of the coating liquid and straightening of steel sheet shape at 800° C. for 20 seconds and further to magnetic domain refining treatment by irradiating electron beams to the steel sheet surface to obtain a product coil.

From the product coil thus obtained is collected a cutlength sheet test piece to measure iron loss W17/50 by SST testing machine (Single Sheet Tester), while an oil-filled transformer of 1000 kVA is manufactured from the remaining product coil to measure iron loss in the actual transformer. Also, the surface of the steel sheet is visually inspected over the full length of coil during the collection of the cutlength sheet test piece to confirm the presence or absence of coating fault such as color shading, point-like coating defect or the like, from which is determined a ratio of non-defective parts having no coating fault over the full length.

The results are also shown in Table 3. As seen from these results, the steel sheets of Invention Examples produced under conditions of the temperature rising rate and the minor ingredient in the annealing separator adaptable to the invention are not only excellent in the iron loss properties and coating properties of the product coil but also are low in the building factor (BF: ratio of iron loss of transformer to iron loss of steel sheet) and have good iron loss properties after the assembling of the transformer.

TABLE 3

| | Annealing separator | | Properties of steel sheet | | Properties of transformer | | |
|---|---|---|---|---|---|---|---|
| | | | Average iron loss of cutlength sheet test piece | Ratio of good coating | Iron loss | | |
| No. | Sr content W (mol %) | Ln (W) | $W_{17/50}$ (W/kg) | (%) | W17/50 (W/kg) | BF | Remarks |
| 1 | 0.005 | −5.3 | 0.79 | 100 | 0.97 | 1.23 | Comparative Example |
| 2 | 0.017 | −4.1 | 0.74 | 100 | 0.81 | 1.09 | Invention Example |
| 3 | 0.025 | −3.7 | 0.78 | 100 | 0.94 | 1.21 | Comparative Example |

The invention claimed is:

1. A method of producing a grain-oriented electrical steel sheet by hot-rolling a steel slab of a chemical composition comprising C: 0.001 to 0.10 mass %, Si: 1.0 to 5.0 mass %, Mn: 0.01 to 1.0 mass %, at least one of S and Se: 0.01 to 0.05 mass % in total, sol. Al: 0.003 to 0.050 mass %, N: 0.001 to 0.020 mass % and the balance being Fe and inevitable impurities, subjecting to single cold rolling or two or more cold rollings including an intermediate annealing therebetween to a final thickness and further to a primary recrystallization annealing, application of an annealing separator composed mainly of MgO and a finish annealing, wherein the primary recrystallization annealing a temperature rising rate S1 between 500 to 600° C. is made to not less than 100° C./s and a temperature rising rate S2 between 600 to 700° C. is made to 30° C./s to 0.6×S1° C./s, while a total content W (mol %) of an element having an ionic radius of 0.6 to 1.3 Å and an attracting force between ion and oxygen of not more than 0.7 $Å^{-2}$ included in the annealing separator to MgO is adjusted to satisfy the following equation (1) in relation to the S2:

$$0.01S2-5.5 \leq \mathrm{Ln}(W) \leq 0.01S2-4.3 \quad (1).$$

2. The method of producing a grain-oriented electrical steel sheet according to claim 1, wherein decarburization annealing is carried out after the primary recrystallization annealing.

3. The method of producing a grain-oriented electrical steel sheet according to claim 1, wherein the element having an ionic radius of 0.6 to 1.3 Å and an attracting force between the ion and oxygen of not more than 0.7 $Å^{-2}$ is at least one of Ca, Sr, Li and Na.

4. The method of producing a grain-oriented electrical steel sheet according to claim 1, wherein in addition to the above chemical composition, the steel slab contains at least one selected from Cu: 0.01 to 0.2 mass %, Ni: 0.01 to 0.5 mass %, Cr: 0.01 to 0.5 mass %, Sb: 0.01 to 0.1 mass %, Sn: 0.01 to 0.5 mass %, Mo: 0.01 to 0.5 mass % and Bi: 0.001 to 0.1 mass %.

5. The method of producing a grain-oriented electrical steel sheet according to claim 1, wherein in addition to the above chemical composition, the steel slab contains at least one selected from B: 0.001 to 0.01 mass %, Ge: 0.001 to 0.1 mass %, As: 0.005 to 0.1 mass %, P: 0.005 to 0.1 mass %, Te: 0.005 to 0.1 mass %, Nb: 0.005 to 0.1 mass %, Ti: 0.005 to 0.1 mass % and V: 0.005 to 0.1 mass %.

6. The method of producing a grain-oriented electrical steel sheet according to claim 2, wherein the element having an ionic radius of 0.6 to 1.3 Å and an attracting force between the ion and oxygen of not more than 0.7 $Å^{-2}$ is at least one of Ca, Sr, Li and Na.

7. The method of producing a grain-oriented electrical steel sheet according to claim 2, wherein in addition to the above chemical composition, the steel slab contains at least one selected from Cu: 0.01 to 0.2 mass %, Ni: 0.01 to 0.5 mass %, Cr: 0.01 to 0.5 mass %, Sb: 0.01 to 0.1 mass %, Sn: 0.01 to 0.5 mass %, Mo: 0.01 to 0.5 mass % and Bi: 0.001 to 0.1 mass %.

8. The method of producing a grain-oriented electrical steel sheet according to claim 3, wherein in addition to the above chemical composition, the steel slab contains at least one selected from Cu: 0.01 to 0.2 mass %, Ni: 0.01 to 0.5 mass %, Cr: 0.01 to 0.5 mass %, Sb: 0.01 to 0.1 mass %, Sn: 0.01 to 0.5 mass %, Mo: 0.01 to 0.5 mass % and Bi: 0.001 to 0.1 mass %.

9. The method of producing a grain-oriented electrical steel sheet according to claim 2, wherein in addition to the above chemical composition, the steel slab contains at least one selected from B: 0.001 to 0.01 mass %, Ge: 0.001 to 0.1 mass %, As: 0.005 to 0.1 mass %, P: 0.005 to 0.1 mass %, Te: 0.005 to 0.1 mass %, Nb: 0.005 to 0.1 mass %, Ti: 0.005 to 0.1 mass % and V: 0.005 to 0.1 mass %.

10. The method of producing a grain-oriented electrical steel sheet according to claim 3, wherein in addition to the above chemical composition, the steel slab contains at least one selected from B: 0.001 to 0.01 mass %, Ge: 0.001 to 0.1 mass %, As: 0.005 to 0.1 mass %, P: 0.005 to 0.1 mass %, Te: 0.005 to 0.1 mass %, Nb: 0.005 to 0.1 mass %, Ti: 0.005 to 0.1 mass % and V: 0.005 to 0.1 mass %.

11. The method of producing a grain-oriented electrical steel sheet according to claim 4, wherein in addition to the above chemical composition, the steel slab contains at least one selected from B: 0.001 to 0.01 mass %, Ge: 0.001 to 0.1 mass %, As: 0.005 to 0.1 mass %, P: 0.005 to 0.1 mass %, Te: 0.005 to 0.1 mass %, Nb: 0.005 to 0.1 mass %, Ti: 0.005 to 0.1 mass % and V: 0.005 to 0.1 mass %.

12. The method of producing a grain-oriented electrical steel sheet according to claim 6, wherein in addition to the above chemical composition, the steel slab contains at least one selected from Cu: 0.01 to 0.2 mass %, Ni: 0.01 to 0.5 mass %, Cr: 0.01 to 0.5 mass %, Sb: 0.01 to 0.1 mass %, Sn: 0.01 to 0.5 mass %, Mo: 0.01 to 0.5 mass % and Bi: 0.001 to 0.1 mass %.

13. The method of producing a grain-oriented electrical steel sheet according to claim 6, wherein in addition to the above chemical composition, the steel slab contains at least one selected from B: 0.001 to 0.01 mass %, Ge: 0.001 to 0.1 mass %, As: 0.005 to 0.1 mass %, P: 0.005 to 0.1 mass %, Te: 0.005 to 0.1 mass %, Nb: 0.005 to 0.1 mass %, Ti: 0.005 to 0.1 mass % and V: 0.005 to 0.1 mass %.

14. The method of producing a grain-oriented electrical steel sheet according to claim 7, wherein in addition to the above chemical composition, the steel slab contains at least one selected from B: 0.001 to 0.01 mass %, Ge: 0.001 to 0.1 mass %, As: 0.005 to 0.1 mass %, P: 0.005 to 0.1 mass %, Te:

0.005 to 0.1 mass %, Nb: 0.005 to 0.1 mass %, Ti: 0.005 to 0.1 mass % and V: 0.005 to 0.1 mass %.

15. The method of producing a grain-oriented electrical steel sheet according to claim 8, wherein in addition to the above chemical composition, the steel slab contains at least one selected from B: 0.001 to 0.01 mass %, Ge: 0.001 to 0.1 mass %, As: 0.005 to 0.1 mass %, P: 0.005 to 0.1 mass %, Te: 0.005 to 0.1 mass %, Nb: 0.005 to 0.1 mass %, Ti: 0.005 to 0.1 mass % and V: 0.005 to 0.1 mass %.

16. The method of producing a grain-oriented electrical steel sheet according to claim 12, wherein in addition to the above chemical composition, the steel slab contains at least one selected from B: 0.001 to 0.01 mass %, Ge: 0.001 to 0.1 mass %, As: 0.005 to 0.1 mass %, P: 0.005 to 0.1 mass %, Te: 0.005 to 0.1 mass %, Nb: 0.005 to 0.1 mass %, Ti: 0.005 to 0.1 mass % and V: 0.005 to 0.1 mass %.

* * * * *